US011718901B2

(12) United States Patent
Watanabe et al.

(10) Patent No.: US 11,718,901 B2
(45) Date of Patent: Aug. 8, 2023

(54) METHOD FOR PRODUCING COATED MAGNETIC POWDER, METHOD FOR PRODUCING DUST CORE, AND METHOD FOR PRODUCING ELECTROMAGNETIC COMPONENT

(71) Applicants: Sumitomo Electric Industries, Ltd., Osaka (JP); Sumitomo Electric Sintered Alloy, Ltd., Takahashi (JP)

(72) Inventors: Asako Watanabe, Itami (JP); Tomoyuki Ueno, Itami (JP)

(73) Assignees: SUMITOMO ELECTRIC INDUSTRIES, LTD., Osaka (JP); SUMITOMO ELECTRIC SINTERED ALLOY, LTD., Takahashi (JP)

( * ) Notice: Subject to any disclaimer, the term of this patent is extended or adjusted under 35 U.S.C. 154(b) by 828 days.

(21) Appl. No.: 16/306,003

(22) PCT Filed: May 17, 2017

(86) PCT No.: PCT/JP2017/018541
§ 371 (c)(1),
(2) Date: Nov. 30, 2018

(87) PCT Pub. No.: WO2017/208824
PCT Pub. Date: Dec. 7, 2017

(65) Prior Publication Data

US 2019/0160527 A1 May 30, 2019

(30) Foreign Application Priority Data

May 30, 2016 (JP) ..... 2016-107750

(51) Int. Cl.
*C22C 38/02* (2006.01)
*H01F 1/26* (2006.01)
(Continued)

(52) U.S. Cl.
CPC ..... *C22C 38/02* (2013.01); *B22F 1/102* (2022.01); *B22F 1/16* (2022.01); *B22F 3/02* (2013.01);
(Continued)

(58) Field of Classification Search
CPC ..... C22C 2202/02; H01F 1/0054; H01F 1/12; H01F 1/16; H01F 1/18; H01F 1/20;
(Continued)

(56) References Cited

U.S. PATENT DOCUMENTS 6,054,219 A * 4/2000 Satsu ..... H01F 1/24 427/220
2002/0084882 A1* 7/2002 Moro ..... H01F 41/0246 336/233
2003/0077448 A1* 4/2003 Ueta ..... H01F 1/26 428/404
(Continued)

FOREIGN PATENT DOCUMENTS

EP 0 484 000 A2 5/1992
EP 2 221 835 A1 8/2010
(Continued)

OTHER PUBLICATIONS

Alain Berthod, Seema Tomer, John G. Dorsey, "Polyoxyethylene alkyl ether nonionic surfactants: physicochemical properties and use for cholesterol determination in food," Talanta, 55, 2001, pp. 69-83. (Year: 2001).*
(Continued)

*Primary Examiner* — Vanessa T. Luk
(74) *Attorney, Agent, or Firm* — Xsensus LLP

(57) ABSTRACT

A method for producing a coated magnetic powder in which particle surfaces of a soft magnetic powder are coated with a silicone resin includes a preparation step of preparing a silicone emulsion by mixing a silicone resin with water
(Continued)

containing a surfactant and dispersing the silicone resin in the water, an application step of applying the silicone emulsion onto particle surfaces of a soft magnetic powder, and a drying step of drying the soft magnetic powder after the silicone emulsion is applied.

17 Claims, 4 Drawing Sheets

(51) Int. Cl.

| | |
|---|---|
| ***H01F 41/02*** | (2006.01) |
| ***B22F 1/102*** | (2022.01) |
| ***B22F 1/16*** | (2022.01) |
| ***C22C 38/06*** | (2006.01) |
| ***H01F 1/147*** | (2006.01) |
| ***B22F 3/02*** | (2006.01) |
| ***B22F 3/24*** | (2006.01) |
| ***H01F 41/04*** | (2006.01) |

(52) U.S. Cl.
CPC ..... *B22F 3/24* (2013.01); *C22C 38/06* (2013.01); *H01F 1/14766* (2013.01); *H01F 1/14791* (2013.01); *H01F 1/26* (2013.01); *H01F 41/02* (2013.01); *H01F 41/0246* (2013.01); *H01F 41/04* (2013.01); *B22F 2003/248* (2013.01); *B22F 2301/35* (2013.01); *B22F 2998/10* (2013.01); *C22C 2202/02* (2013.01)

(58) Field of Classification Search
CPC ..... H01F 1/22; H01F 1/24; H01F 1/26; H01F 1/28; B22F 1/00; B22F 1/0003; B22F 1/0059; B22F 1/0062; B22F 1/0074; B22F 1/0077; B22F 1/0081; B22F 1/0088; B22F 1/02; B22F 2001/0066; B22F 2001/0092; B22F 2301/35; B22F 2301/355; C08L 83/04
See application file for complete search history.

(56) References Cited

U.S. PATENT DOCUMENTS

| | | | | |
|---|---|---|---|---|
| 2009/0121175 | A1* | 5/2009 | Maeda | H01F 1/26 252/62.51 R |
| 2010/0212455 | A1* | 8/2010 | Ohwaki | H01F 1/24 75/246 |
| 2012/0001710 | A1 | 1/2012 | Wakabayashi et al. | |

FOREIGN PATENT DOCUMENTS

| | | | | |
|---|---|---|---|---|
| JP | 05-125281 | A | 5/1993 | |
| JP | 07-196984 | A | 8/1995 | |
| JP | 2000-223308 | A | 8/2000 | |
| JP | 2006-225629 | A | 8/2006 | |
| JP | 2008-063651 | A | 3/2008 | |
| JP | 2009-253030 | A | 10/2009 | |
| JP | 2011-029605 | A | 2/2011 | |
| JP | 2014-031413 | A | 2/2014 | |
| WO | 2010/103709 | A1 | 9/2010 | |
| WO | WO-2015199696 | A1 * | 12/2015 | F26B 3/08 |
| WO | WO-2016014609 | A1 * | 1/2016 | C08L 83/12 |

OTHER PUBLICATIONS

Tetens's Formula, Glossary of Meteorology, American Meteorological Society, retrieved from https://glossary.ametsoc.org/w/index.php?title=Tetens%27s_formula&oldid=4009, page edited on Feb. 20, 2012. (Year: 2012).*
Chemical-navi powered by Nikko Chemicals, Product Details, NIKKOL BL-21, copyright 2010, site accessed 05May 2, 2022, 3 pages. (Year: 2010).*
Sigma Aldrich, Safety Data Sheet, Decaethylene glycol monododecyl ether, CAS No. 9002-92-0, revision date Sep. 2, 2021, print date Apr. 30, 2022, 9 pages. (Year: 2021).*
Toryo Coating-yo Silicone, Dow Corning Toray Co., Ltd., 2010. 06, p. 5. [Cited in ISR/WO].
Kagaku Busshitsu no Kankyo Risk Hyoka, vol. 7, 1st series (3), Ministry of the Environment Kankyo Hokenbu Kankyo Risk Hyokashitsu, 2009. 03, [10] p. 1 [Cited in ISR/WO].
Written Opinion issued in corresponding International Application No. PCT/JP2017/018541 dated Aug. 8, 2017.

* cited by examiner

METHOD FOR PRODUCING COATED MAGNETIC POWDER, METHOD FOR PRODUCING DUST CORE, AND METHOD FOR PRODUCING ELECTROMAGNETIC COMPONENT

TECHNICAL FIELD

The present invention relates to a method for producing a coated magnetic powder, a method for producing a dust core, and a method for producing an electromagnetic component.

The present application claims the priority based on Japanese Patent Application No. 2016-107750 filed on May 30, 2016, the entire contents of which are incorporated herein by reference.

BACKGROUND ART

Dust cores have been used as cores for electromagnetic components such as reactors and motors. In general, dust cores are produced by compacting a coated magnetic powder that serves as a raw material and is obtained by covering particle surfaces of a soft magnetic powder with an insulating coating. When particle surfaces of a soft magnetic powder are covered with an insulating coating, the insulating coating is interposed between the particles of the soft magnetic powder constituting a dust core, which makes it difficult to bring the particles into direct contact with each other. This improves the insulation between the particles and reduces the eddy-current loss of the dust core, thereby reducing the iron loss (core loss). The insulating coating is formed of, for example, a silicone resin.

A silicone resin coating can be formed on the particle surfaces of the soft magnetic powder by a method in which a silicone resin is dissolved in an organic solvent (e.g., xylene) and the resulting solution is applied onto the particle surfaces of the soft magnetic powder (e.g., refer to PTL 1 and PTL 2).

CITATION LIST

Patent Literature

PTL 1: Japanese Unexamined Patent Application Publication No. 2000-223308

PTL 2: Japanese Unexamined Patent Application Publication No. 2011-29605

SUMMARY OF INVENTION

A method for producing a coated magnetic powder according to the present disclosure is a method for producing a coated magnetic powder in which particle surfaces of a soft magnetic powder are coated with a silicone resin, the method including a preparation step of preparing a silicone emulsion by mixing a silicone resin with water containing a surfactant and dispersing the silicone resin in the water; an application step of applying the silicone emulsion onto particle surfaces of a soft magnetic powder; and a drying step of drying the soft magnetic powder after the silicone emulsion is applied.

A method for producing a dust core according to the present disclosure includes a compaction step of compacting a coated magnetic powder produced by the method for producing a coated magnetic powder to obtain a green compact; and a heat treatment step of heating the green compact.

A method for producing an electromagnetic component according to the present disclosure includes a step of providing a coil to a dust core produced by the method for producing a dust core.

DESCRIPTION OF EMBODIMENTS

Problem to be Solved by the Disclosure

From the viewpoint of further reducing the iron loss due to eddy-current loss of dust cores, a dense silicone resin coating is desirably formed on particle surfaces of a soft magnetic powder. The insulation between particles of the soft magnetic powder is improved by increasing the density of the silicone resin coating. Thus, the iron loss of dust cores can be further reduced.

Accordingly, it is an object of the present disclosure to provide a method for producing a coated magnetic powder in which a dense silicone resin coating can be formed on particle surfaces of a soft magnetic powder. It is another object of the present disclosure to provide a method for producing a dust core with low iron loss. It is still another object of the present disclosure to provide a method for producing an electromagnetic component with low iron loss and high energy efficiency.

Advantageous Effects of Disclosure

In the method for producing a coated magnetic powder, a dense silicone resin coating can be formed on particle surfaces of a soft magnetic powder. In the method for producing a dust core, a dust core with low iron loss can be produced. In the method for producing an electromagnetic component, an electromagnetic component with low iron loss and high energy efficiency can be produced.

DESCRIPTION OF EMBODIMENTS OF THE PRESENT INVENTION

As a result of thorough studies on the method for forming a dense silicone resin coating on particle surfaces of a soft magnetic powder, the present inventors have found the following.

Figure 2:
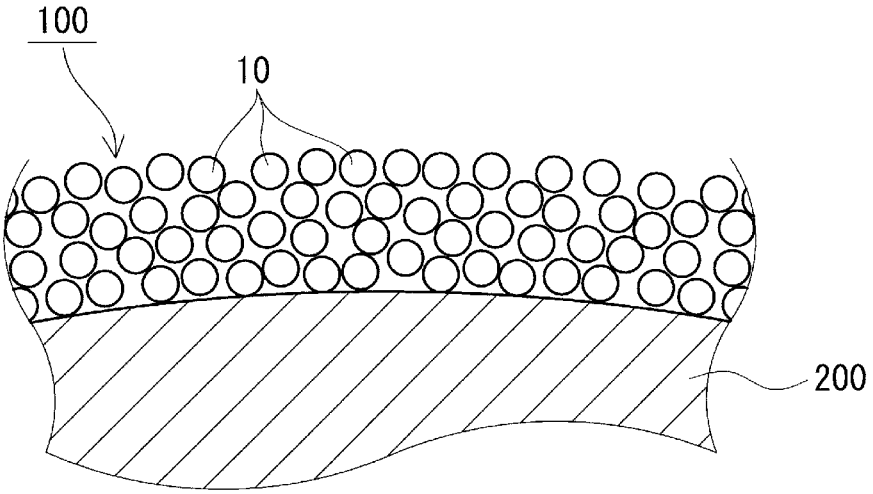
FIG. 2 is a conceptual diagram illustrating a silicone resin coating formed by a known production method.

In the related art, a solution prepared by dissolving a silicone resin in an organic solvent is used for formation of a silicone resin coating. When a silicone resin is dissolved in an organic solvent, the molecular bond is cleaved and silicone molecules are present in a monomolecular state, and monomolecular silicone resin particles (hereafter may be referred to as "silicone particles") are dissolved in the organic solvent. In the case where this silicone resin organic solvent solution is applied onto particle surfaces of a soft magnetic powder to form a coating, a silicone resin coating 100 having a structure in which fine silicone particles 10 are accumulated on a surface of each particle 200 of the soft magnetic powder is formed as illustrated in FIG. 2. Gaps are formed between the particles 10 and thus the coating 100 having a structure in which the fine particles 10 are accumulated has many gaps, which makes it difficult to increase the density. Therefore, in a known method that uses a silicone resin organic solvent solution, it is believed to be difficult to form a dense silicone resin coating.

As a result of further studies conducted by the present inventors, they have found that a dense silicone resin coating can be formed by using a silicone emulsion prepared by mixing a silicone resin with water containing a surfactant. The reason for this is believed to be as follows.

Figure 1:
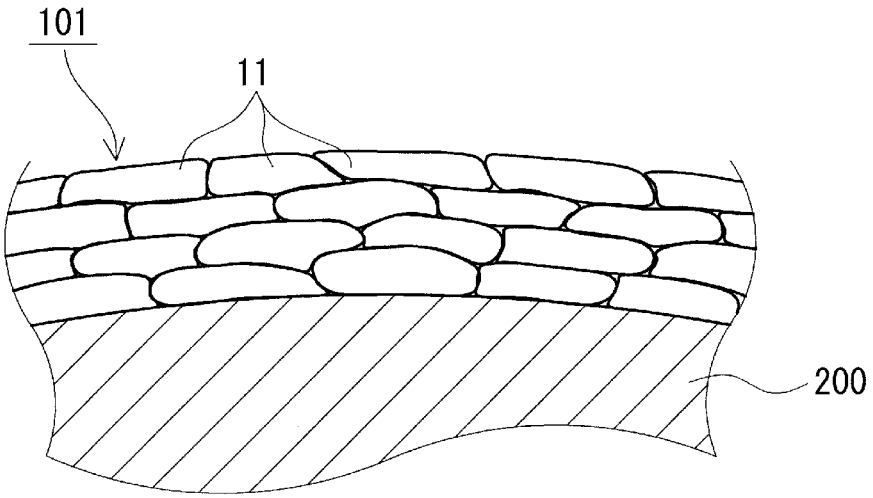
FIG. 1 is a conceptual diagram illustrating a silicone resin coating formed by a production method according to an embodiment of the present invention.

Since the silicone resin is insoluble in water, the molecular bond is maintained and thus the silicone resin is present while a plurality of silicone molecules bond to each other. The silicone emulsion is in a state in which the silicone resin is emulsified in water by a surfactant. In the state of silicone emulsion, the surfactant covers a surface of an assembly (cluster) of a plurality of silicone molecules bonded to each other, and silicone particles constituted by a plurality of silicone molecules are uniformly dispersed in water. In the case where the silicone emulsion is applied onto surfaces of soft magnetic particles to form a coating, a silicone resin coating 101 having a structure in which silicone particles 11 of the molecular assembly are accumulated on a surface of each particle 200 of the soft magnetic powder is formed as illustrated in FIG. 1. The emulsified silicone particles 11 are the molecular assembly and have a larger particle size than the monomolecular particles 10 in FIG. 2. Therefore, the coating 101 having a structure in which the silicone particles 11 are accumulated has a small number of gaps, thereby increasing the coating density. Furthermore, the silicone particles 11 have large deformability because they are not in a solid state, but in an emulsified state. Therefore, the silicone particles 11 accumulate while being in close contact with each other, which improves the density of the coating 101.

Hereafter, embodiments of the present invention will be listed and described.

Figure 3:
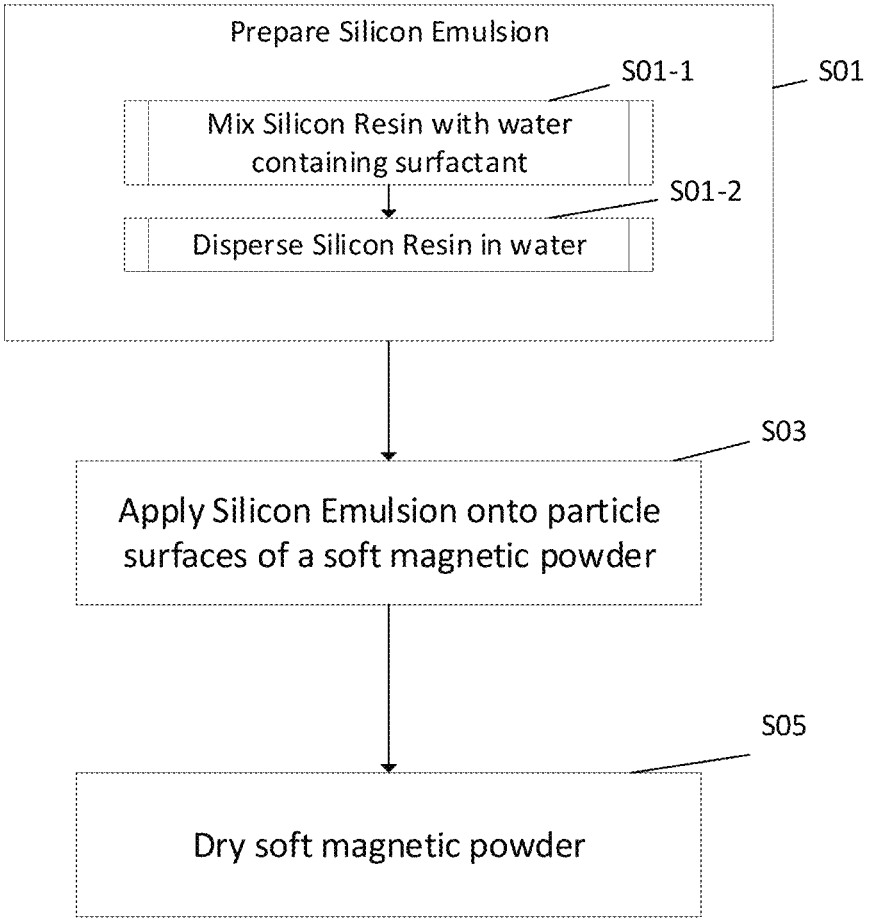
FIG. 3 is a flowchart of a process performed according to an embodiment.

(1) A method for producing a coated magnetic powder according to an embodiment of the present invention is a method for producing a coated magnetic powder in which particle surfaces of a soft magnetic powder are coated with a silicone resin, the method including a preparation step of preparing a silicone emulsion by mixing a silicone resin with water containing a surfactant and dispersing the silicone resin in the water; an application step of applying the silicone emulsion onto particle surfaces of a soft magnetic powder; and a drying step of drying the soft magnetic powder after the silicone emulsion is applied. This method is shown as a flowchart in FIG. 3, with the process beginning in step S01, in which the silicon emulsion is prepared in sub-steps S01-1 and S01-2 in which silicon resin is mixed with water containing a surfactant, and dispersed in the water. The process then proceeds to step S03 where the silicon emulsion is applied to particle surfaces of a soft magnetic powder respectively, and then dried in step S05.

In this method for producing a coated magnetic powder, a dense silicone resin coating can be formed by applying a silicone emulsion prepared through emulsification of a silicone resin in water onto particle surfaces of a soft magnetic powder and drying the soft magnetic powder. Therefore, a coated magnetic powder produced by the method for producing a coated magnetic powder has a dense silicone resin coating on particle surfaces of the soft magnetic powder. When the coated magnetic powder is used as a raw material for dust cores, the iron loss due to eddy-current loss of dust cores can be reduced.

The silicone emulsion is prepared using water as a solvent, but not an organic solvent. Therefore, the silicone emulsion is excellent in terms of cost, safety, environmental friendliness, and workability. For example, an organic solvent having high volatility (flammability) is not used, which does not require an explosion-proof apparatus. Thus, the cost for facilities can be reduced and the apparatus can be easily cleaned.

(2) In an embodiment of the method for producing a coated magnetic powder, the silicone resin has a weight-average molecular weight of 1000 or more and 30000 or less.

When a polymer silicone resin having a weight-average molecular weight of 1000 or more is used, the particle size of the emulsified silicone particles is large, which improves the coating density. When the silicone resin has a weight-average molecular weight of 30000 or less, the silicone emulsion is easily applied onto particle surfaces of the soft magnetic powder with a uniform thickness, which makes it easy to form a dense coating having a uniform thickness. When the silicone resin has a weight-average molecular weight of 30000 or less, emulsification is easily performed and thus the silicone particles are easily uniformly dispersed in water. The weight-average molecular weight of the silicone resin is, for example, preferably 10000 or less and more preferably 5000 or less.

(3) In an embodiment of the method for producing a coated magnetic powder, the silicone resin is a methyl phenyl silicone resin in which some of methyl groups are substituted with phenyl groups, the silicone resin containing the phenyl groups in an amount of 20 mol % or more and 50 mol % or less.

The silicone resin has a molecular structure including a main chain constituted by polysiloxane bonds and side chains to which organic groups bond. Examples of the organic groups include a methyl group ($CH_3$) and a phenyl group ($C_6H_5$). Specific examples of the silicone resin include methyl silicone resins in which all side chains and terminals of a polysiloxane are methyl groups and methyl phenyl silicone resins in which some of methyl groups in the methyl silicone resin are substituted with phenyl groups so that some of side chains of the polysiloxane are phenyl groups. By substituting some of methyl groups with phenyl groups, the heat resistance is improved. A methyl phenyl silicone resin containing 20 mol % or more of phenyl groups has high heat resistance. Thus, a coating having high heat resistance can be formed. When the content of the phenyl groups is 50 mol % or less, high flexibility is achieved and silicone particles come in close contact with each other when the coating is formed by applying a silicone emulsion onto surfaces of soft magnetic particles and thus a dense coating is easily formed. The content (mol %) of phenyl groups refers to a ratio of the number of moles of phenyl groups relative to the total number of moles of methyl groups and phenyl groups, which is assumed to be 100 mol %.

(4) In an embodiment of the method for producing a coated magnetic powder, the soft magnetic powder is formed of an Fe—Si—Al-based alloy or an Fe—Si-based alloy and has a Vickers hardness of HV 150 or more.

When the soft magnetic powder is a soft magnetic material powder formed of an Fe—Si—Al-based alloy or an Fe—Si-based alloy, the iron loss of dust cores can be further reduced. When the soft magnetic powder (soft magnetic material) has a Vickers hardness of HV 150 or more, the separation of a silicone resin coating due to deformation of the soft magnetic powder during compaction is easily suppressed in a production process of dust cores. The upper limit of the Vickers hardness is, for example, HV 800 or less from the viewpoint of moldability during compaction and the component system of the iron-based alloy.

(5) In an embodiment of the method for producing a coated magnetic powder, a silicone resin coating on the particle surfaces of the soft magnetic powder has a pencil hardness of H or more and 6H or less.

When the pencil hardness of the silicone resin coating is H or more, the silicone resin coating has high strength and the coating is not easily damaged during compaction. When the pencil hardness of the silicone resin coating is 6H or less, the silicone resin coating has high flexibility and the coating is not easily separated from the particle surfaces of the soft magnetic powder during compaction. Furthermore, high flexibility of the silicone resin coating does not easily inhibit the plastic deformation of the soft magnetic powder during compaction, which can increase the density of a green compact (dust core) and thus can increase the magnetic permeability of the dust core. Therefore, when the silicone resin coating has a pencil hardness of H or more and 6H or less, the damage to and separation of the silicone resin coating during compaction can be suppressed, which can effectively reduce the iron loss of the dust core.

(6) In an embodiment of the method for producing a coated magnetic powder, the surfactant is a nonionic surfactant having a polyoxyethylene structure and has a weight-average molecular weight of 300 or more and 700 or less.

The nonionic surfactant having a polyoxyethylene $(CH_2CH_2O)_n$ structure has high stability and good emulsion dispersibility. The silicone resin is easily dispersed in water by using such a surfactant through emulsification. When the surfactant has a weight-average molecular weight of 300 or more and 700 or less, the silicone particles are easily uniformly dispersed. Furthermore, since the nonionic surfactant has high stability, other emulsions such as an aqueous solution of another resin and a wax can also be used in combination.

(7) In an embodiment of the method for producing a coated magnetic powder, the drying step is performed at a saturated water vapor pressure of 20 kPa or more.

When the soft magnetic powder to which the silicone emulsion has been applied is dried at a saturated water vapor pressure of 20 kPa or more, water is rapidly evaporated from the silicone emulsion, which makes it easy to suppress oxidation of the soft magnetic powder.

(8) In an embodiment of the method for producing a coated magnetic powder, a content of the silicone resin in the silicone emulsion is 10 mass % or more and 60 mass % or less.

When the content of the silicone resin is 10 mass % or more, a sufficient amount of silicone particles can be provided in the silicone emulsion, which makes it easy to form a coating having a predetermined thickness. When the content of the silicone resin is 60 mass % or less, the dispersibility of the silicone emulsion can be improved. Consequently, the silicone emulsion is easily applied onto particle surfaces of the soft magnetic powder with a uniform thickness, and thus a dense coating with a uniform thickness is easily formed. The content (mass %) of the silicone resin refers to a ratio of the mass of the silicone resin relative to the total mass of water and the silicone resin, which is assumed to be 100 mass %.

(9) In an embodiment of the method for producing a coated magnetic powder, an average particle size of particles of the silicone resin dispersed in the silicone emulsion is 200 nm or more.

When the average particle size of the emulsified silicone particles is 200 nm or more, the coating density is improved. The average particle size of the silicone particles is measured with a laser diffraction/scattering particle size distribution analyzer and refers to a particle size at which the cumulative mass reaches 50% of the mass of all particles.

Figure 4:
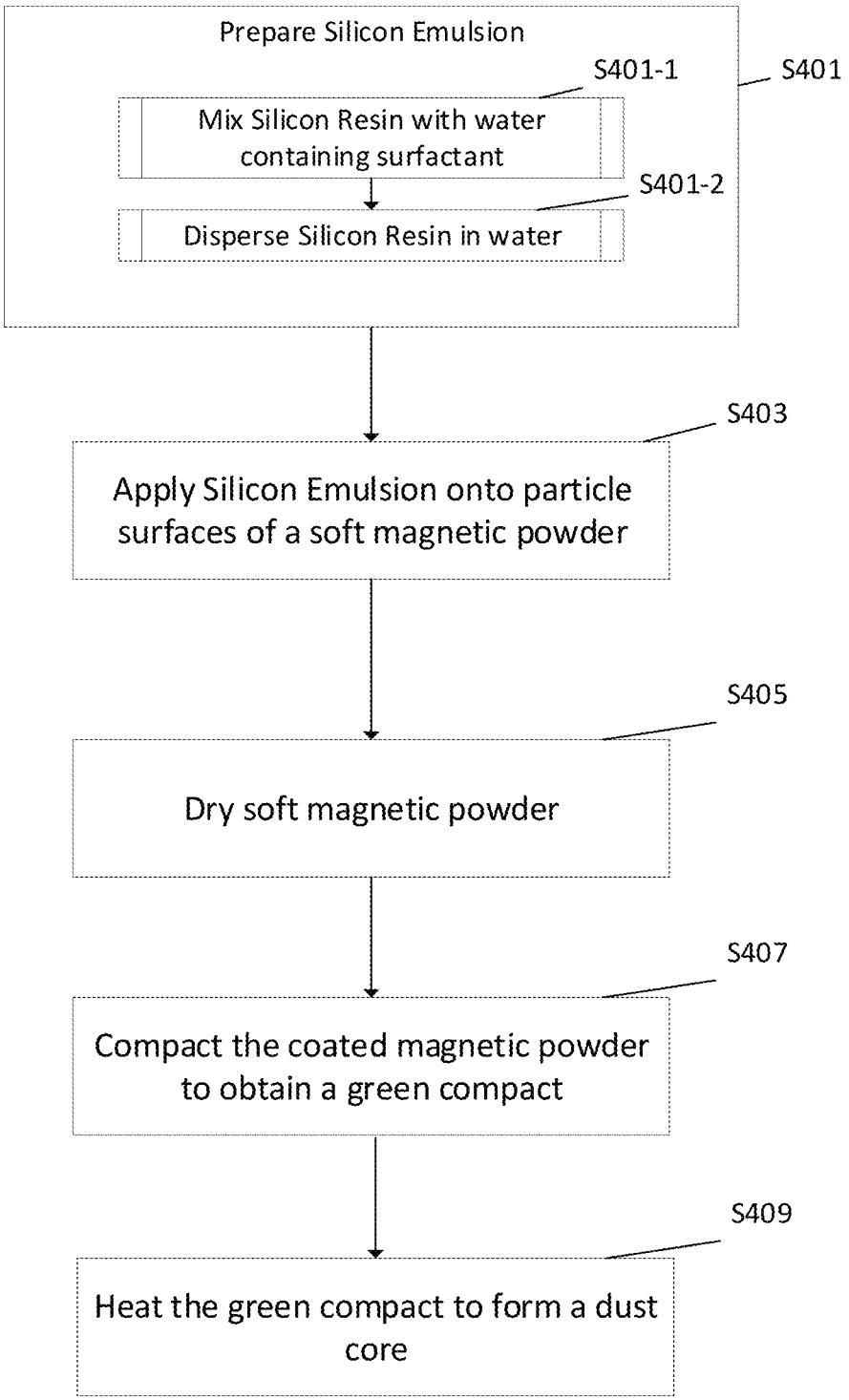
FIG. 4 is a flowchart of a process for forming a dust core according to an embodiment.

(10) A method for producing a dust core according to an embodiment of the present invention includes a compaction step of compacting a coated magnetic powder produced by the method for producing a coated magnetic powder according to any one of (1) to (9) to obtain a green compact; and a heat treatment step of heating the green compact. This method is shown as a flowchart in FIG. 4, with the process beginning in step S401, in which the silicon emulsion is prepared in sub-steps S401-1 and S401-2 in which silicon resin is mixed with water containing a surfactant, and dispersed in the water. The process then proceeds to step S403 where the silicon emulsion is applied to particle surfaces of a soft magnetic powder respectively, and then dried in step S405. Subsequently the process proceeds to step S407 where the dried magnetic powder is compacted, and then heated in step S409 to form a dust core.

In the method for producing a dust core, a coated magnetic powder produced by the method for producing a coated magnetic powder according to an embodiment of the present invention is used as a raw material for dust cores. Therefore, a dust core with low iron loss can be produced.

In the heat treatment step, for example, a green compact is heated in order to remove strain introduced into the green compact during compaction. By heating the green compact to remove the strain, the hysteresis loss of the dust core can be reduced, thereby reducing the iron loss.

When the green compact is heat-treated, heat may change the silicone resin coating into an insulating coating having a composition containing Si and C. The silicone resin may also change into silicon oxide such as silica ($SiO_2$), and thus the insulating coating may contain $SiO_2$. Even if the heat treatment changes the composition of the coating formed on particles of the soft magnetic powder, the coating density is maintained. Therefore, the particles of the soft magnetic powder are insulated from each other in the dust core.

Figure 5:
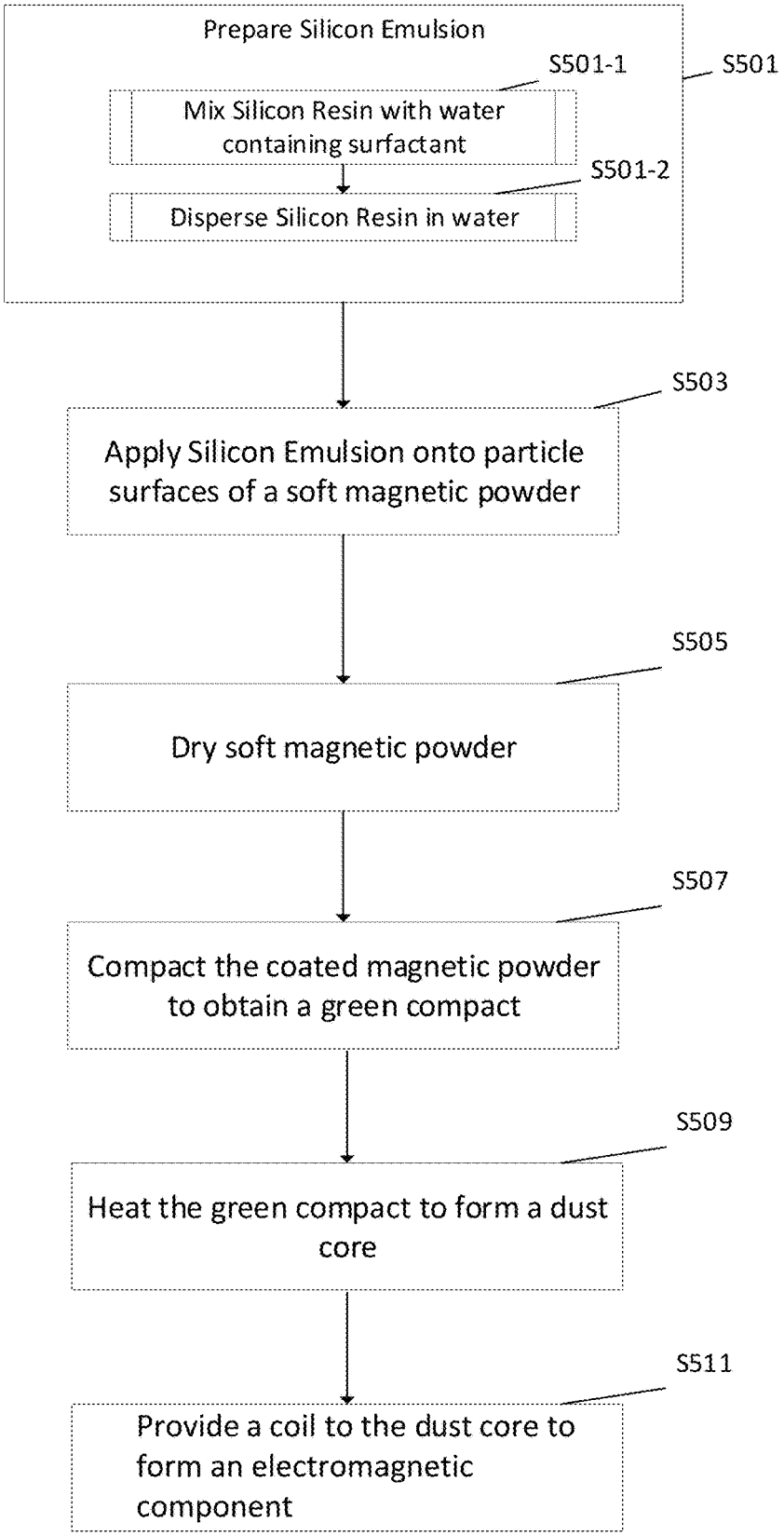
FIG. 5 is a flowchart of a process for forming an electromagnetic component according to an embodiment.

(11) A method for producing an electromagnetic component according to an embodiment of the present invention includes a step of providing a coil to a dust core produced by the method for producing a dust core according to (10). This method is shown as a flowchart in FIG. 5, with the process beginning in step S501, in which the silicon emulsion is prepared in sub-steps S501-1 and S501-2 in which silicon resin is mixed with water containing a surfactant, and dispersed in the water. The process then proceeds to step S503 where the silicon emulsion is applied to particle surfaces of a soft magnetic powder respectively, and then dried in step S505. Subsequently the process proceeds to step S507 where the dried magnetic powder is compacted, and then heated in step S509 to form a dust core. In step S511, a coil is then applied to the dust core to form an electromagnetic component.

In the method for producing an electromagnetic component, a dust core produced by the method for producing a dust core according to an embodiment of the present invention is used as a core for electromagnetic components. Therefore, an electromagnetic component with low iron loss and high energy efficiency can be produced. Examples of an electromagnetic component including a dust core and a coil provided to the dust core include reactors and motors.

Details of Embodiments of the Present Invention

The method for producing a coated magnetic powder, the method for producing a dust core, and the method for producing an electromagnetic component according to embodiments of the present invention will be specifically described below. The present invention is not limited to these examples but is defined by the claims, and is intended to include all modifications within the meaning and scope equivalent to those of the claims.

<Method for Producing Coated Magnetic Powder>

In the method for producing a coated magnetic powder according to an embodiment, particle surfaces of a soft magnetic powder are coated with a silicone resin. The method includes a preparation step of preparing a silicone emulsion, an application step of applying the silicone emulsion onto particle surfaces of a soft magnetic powder, and a drying step of drying the soft magnetic powder after the application. One of features of the method for producing a coated magnetic powder according to an embodiment is that a silicone resin coating is formed by applying a silicone emulsion in which a silicone resin is dispersed in water by using a surfactant onto particle surfaces of a soft magnetic powder and drying the soft magnetic powder. Hereafter, each of the steps will be described in detail.

(Soft Magnetic Powder)

First, the soft magnetic powder will be described. The soft magnetic powder is a powder of a soft magnetic material and is constituted by a plurality of particles. Examples of the soft magnetic material include pure iron (purity: 99 mass % or more) and iron-based alloys such as an Fe—Si—Al-based alloy (Sendust), an Fe—Si-based alloy (silicon steel), an Fe—Al-based alloy, and an Fe—Ni-based alloy (Permalloy). A soft magnetic powder produced by, for example, an atomization process (water atomization process or gas atomization process), a carbonyl process, or a reduction process can be used. The soft magnetic powder may be a publicly known soft magnetic powder.

The soft magnetic powder is preferably an alloy powder having good magnetic properties. When a powder formed of an Fe—Si—Al-based alloy or an Fe—Si-based alloy is used as the soft magnetic powder, a dust core with lower iron loss can be provided.

The soft magnetic powder preferably has a Vickers hardness of HV 150 or more. The use of the soft magnetic powder with HV 150 or more can suppress separation of a silicone resin coating due to deformation of the soft magnetic powder during compaction in a production process of a dust core. The upper limit of the Vickers hardness is preferably, for example, HV 800 or less from the viewpoint of moldability during compaction.

The average particle size of the soft magnetic powder is, for example, 20 μm or more and 300 μm or less or 40 μm or more and 250 μm or less. When the average particle size of the soft magnetic powder is within the above range, the soft magnetic powder is easily handled and compacted. The average particle size of the soft magnetic powder is measured with a laser diffraction/scattering particle size distribution analyzer and refers to a particle size at which the cumulative mass reaches 50% of the mass of all particles.

<Preparation Step>

The preparation step is a step of preparing a silicone emulsion by mixing a silicone resin with water containing a surfactant and dispersing the silicone resin in the water.

(Silicone Resin)

A silicone resin having a weight-average molecular weight of, for example, 1000 or more and 30000 or less can be used. When the silicone resin has a weight-average molecular weight of 1000 or more, the particle size of silicone particles dispersed in a silicone emulsion is large, which improves the coating density. The weight-average molecular weight of the silicone resin is preferably 30000 or less. This makes it easy to apply a silicone emulsion onto particle surfaces of the soft magnetic powder with a uniform thickness in the application step, and thus a dense coating with a uniform thickness is easily formed. When the weight-average molecular weight of the silicone resin is 30000 or less, emulsification is easily performed and silicone particles are easily uniformly dispersed in water. The weight-average molecular weight of the silicone resin is, for example, preferably 10000 or less and more preferably 5000 or less. The weight-average molecular weight of the silicone resin can be measured by gel permeation chromatography.

Examples of the silicone resin include methyl silicone resins (dimethyl silicone resin) in which all side chains and terminals of a polysiloxane are methyl groups and methyl phenyl silicone resins in which some of side chains of a polysiloxane are phenyl groups. In particular, a methyl phenyl silicone resin in which some of methyl groups are substituted with phenyl groups has high heat resistance and thus a coating having high heat resistance can be formed. In the case of the methyl phenyl silicone resin, the content of the phenyl groups is preferably 20 mol % or more and 50 mol % or less. When the content of the phenyl groups is 20 mol % or more, the heat resistance is improved. When the content of the phenyl groups is 50 mol % or less, high flexibility is achieved and silicone particles come in close contact with each other when the coating is formed by applying a silicone emulsion onto surfaces of soft magnetic particles and thus a dense coating is easily formed. The content of phenyl groups can be determined as follows. A molar ratio is calculated from the peak intensity ratio of methyl groups and phenyl groups in an infrared absorption spectrum measured by infrared spectroscopic analysis. Then, the content of phenyl groups is determined from the molar ratio of phenyl groups to the total of methyl groups and phenyl groups, which is assumed to be 100 mol.

(Surfactant)

The surfactant is used to disperse a silicone resin in water through emulsification. The surfactant may be, for example, a nonionic surfactant having a polyoxyethylene $(CH_2CH_2O)_n$ structure. The weight-average molecular weight of the surfactant is, for example, 300 or more and 700 or less, which makes it easy to uniformly disperse the silicone particles. Examples of the surfactant include polyoxyethylene alkyl ethers (AE) and polyoxyethylene alkyl phenyl ethers (APE). The weight-average molecular weight of the surfactant can be measured by matrix-assisted laser desorption/ionization.

(Silicone Emulsion)

The silicone emulsion is obtained by dispersing the silicone resin in water using a surfactant. In the state of silicone emulsion, the surfactant covers a surface of an assembly (cluster) of a plurality of silicone molecules bonded to each other, and silicone particles constituted by a plurality of silicone molecules are uniformly dispersed in water.

Content of Silicone Resin

The content of the silicone resin in the silicone emulsion is, for example, 10 mass % or more and 60 mass % or less. When the content of the silicone resin is 10 mass % or more, a sufficient amount of silicone particles can be provided in the silicone emulsion, which makes it easy to form a coating having a predetermined thickness. When the content of the silicone resin is 60 mass % or less, the dispersibility of the silicone emulsion can be improved. Consequently, the silicone emulsion is easily applied onto particle surfaces of the soft magnetic powder with a uniform thickness, and thus a dense coating with a uniform thickness is easily formed. The content of the silicone resin is preferably, for example, 20 mass % or more and 50 mass % or less.

Average Particle Size of Silicone Particles

The average particle size of the silicone particles in the silicone emulsion is, for example, 200 nm or more. When the average particle size of the silicone particles is 200 nm or more, the coating density is improved.

<Application Step>

The application step is a step of applying the silicone emulsion onto particle surfaces of a soft magnetic powder.

The silicone emulsion can be applied by any publicly known method. For example, the soft magnetic powder is immersed in the silicone emulsion, the silicone emulsion is sprayed onto the soft magnetic powder, or the soft magnetic powder and the silicone emulsion are mixed with each other under stirring. The amount of the silicone emulsion applied is dependent on the thickness of a silicone resin coating to be formed, but is, for example, adjusted so that the solid content (silicone resin) of the silicone emulsion is 0.05 parts by weight or more and 1.0 part by weight or less relative to 100 parts by weight of the soft magnetic powder.

<Drying Step>

The drying step is a step of drying the soft magnetic powder after the silicone emulsion is applied.

By drying the soft magnetic powder, water is evaporated from the silicone emulsion. Thus, a silicone resin coating formed of accumulated silicone particles is formed on particle surfaces of the soft magnetic powder. The drying step is performed, for example, at a saturated water vapor pressure of 20 kPa or more. When the saturated water vapor pressure in a drying atmosphere is set to 20 kPa or more, water is rapidly evaporated from the silicone emulsion, which makes it easy to suppress oxidation of the soft magnetic powder. The drying atmosphere is generally an air atmosphere, but is not limited thereto and may be a non-oxidizing atmosphere such as a nitrogen atmosphere or an Ar atmosphere.

From the viewpoint of suppressing oxidation of the soft magnetic powder, the drying is preferably performed immediately after the silicone emulsion is applied. For example, by performing the application at a saturated water vapor pressure of 20 kPa or more, the application and the drying can be simultaneously performed.

(Hardness of Silicone Resin Coating)

The silicone resin coating preferably has a pencil hardness of H or more and 6H or less. When the pencil hardness of the silicone resin coating is H or more, the silicone resin coating has high strength and the coating is not easily damaged during compaction. When the pencil hardness of the silicone resin coating is 6H or less, the silicone resin coating has high flexibility and the coating is not easily separated from the particle surfaces of the soft magnetic powder during compaction. Furthermore, high flexibility of the silicone resin coating does not easily inhibit the plastic deformation of the soft magnetic powder during compaction, which can increase the density of a green compact (dust core) and thus can increase the magnetic permeability of the dust core. Therefore, when the silicone resin coating has a pencil hardness of H or more and 6H or less, the damage to and separation of the silicone resin coating during compaction can be suppressed, which can effectively reduce the iron loss of the dust core. The hardness of the silicone resin coating can be changed in accordance with, for example, the type and composition of silicone resin, the structure, and the production conditions. For example, in the case where a methyl phenyl silicone resin is used as the silicone resin, the hardness of the coating varies depending on the content of the phenyl group. The hardness tends to increase (the flexibility tends to decrease) as the content of the phenyl group increases. Furthermore, the hardness tends to increase (the flexibility tends to decrease) as the content of Si in the silicone resin increases, that is, as the content of organic substituents such as a methyl group and a phenyl group in the silicone resin decreases.

The hardness of the silicone resin coating is determined as follows. The silicone emulsion is applied onto a steel sheet and then dried to form a silicone resin coating. The pencil hardness of the silicone resin coating on the surface of the steel sheet is measured. The measured pencil hardness is regarded as the hardness of the silicone resin coating on particle surfaces of the soft magnetic powder. The pencil hardness of the silicone resin coating is measured by pressing a pencil against the coating at an angle of 45° at a load of 750 g in conformity with "Scratch hardness (Pencil method)" of JIS K 5600-5-4:1999.

Advantageous Effects

The above-described method for producing a coated magnetic powder according to an embodiment provides the following effects.

(1) A dense silicone resin coating can be formed by applying a silicone emulsion prepared by dispersing a silicone resin in water using a surfactant onto particle surfaces of a soft magnetic powder and drying the soft magnetic powder.

The silicone particles in the silicone emulsion are present in the form of a molecular assembly of a plurality of silicone molecules bonded to each other. Therefore, when the silicone emulsion is applied onto surfaces of soft magnetic particles to form a coating, a silicone resin coating having a structure in which the silicone particles of the molecular assembly are accumulated is formed on the particle surfaces of the soft magnetic powder (refer to FIG. 1). Since the silicone particles of the molecular assembly have a large particle size, the gaps between the particles are small when the coating is formed, which can increase the density of the coating. Furthermore, the silicone particles have large deformability because they are not in a solid state, but in an emulsified state. Therefore, when the coating is formed, the silicone particles accumulate while being in close contact with each other, which improves the coating density.

(2) The silicone emulsion contains water as a solvent and is thus excellent in terms of cost, safety, environmental friendliness, and workability. For example, an organic solvent having high volatility (flammability) is not used as a solvent, which does not require an explosion-proof apparatus. Thus, the cost for facilities can be reduced and the apparatus can be easily cleaned.

<<Use of Coated Magnetic Powder>>

The coated magnetic powder produced by the above-described method for producing a coated magnetic powder according to an embodiment can be used as a raw material for dust cores. The coated magnetic powder has a dense silicone resin coating on the particle surfaces of the soft magnetic powder. Therefore, when a dust core is produced, the particles of the soft magnetic powder can be insulated from each other, which can reduce the iron loss due to eddy-current loss of the dust core. The silicone resin coating has a thickness of, for example, 0.05 μm or more and 3 μm or less. In particular, when a silicone resin coating is formed using a methyl phenyl silicone resin containing 20 mol % or more and 50 mol % or less of phenyl groups, a coated magnetic powder having a dense silicone resin coating with high heat resistance is provided.

<Method for Producing Dust Core>

The method for producing a dust core according to an embodiment includes a compaction step of compacting a coated magnetic powder to obtain a green compact and a heat treatment step of heating the green compact. One of features of the method for producing a dust core according to an embodiment is that a coated magnetic powder produced by the above-described method for producing a coated magnetic powder according to an embodiment is used as a raw material for dust cores.

<Compaction Step>

The compaction step is a step of compacting a coated magnetic powder produced by the above-described method for producing a coated magnetic powder according to an embodiment to obtain a green compact.

The compaction is performed, for example, by filling a mold with a coated magnetic powder and performing press molding. The compaction can be performed using a publicly known press. As the molding pressure during compaction is increased, the density of the green compact can be increased and consequently the density of the dust core can be increased. The molding pressure is, for example, 600 MPa or more or 700 MPa or more. The upper limit of the molding pressure is, for example, 1500 MPa or less from the viewpoint of production. To increase the moldability of the coated magnetic powder, for example, hot compaction may be performed by heating a mold. In the case of hot compaction, the molding temperature (mold temperature) is, for example, 60° C. or higher or 80° C. or higher. The upper limit of the molding temperature is, for example, 200° C. or lower.

<Heat Treatment Step>

The heat treatment step is a step of heating a green compact. The main purpose of the heat treatment step is to remove strain introduced into the green compact during compaction. By heating the green compact to remove strain, the magnetic permeability can be improved and thus the iron loss due to hysteresis loss of the dust core can be reduced. The heating temperature is, for example, 600° C. or higher. In particular, when heat treatment is performed at a high temperature of 700° C. or higher, the hysteresis loss can be considerably reduced. The upper limit of the heating temperature is, for example, 900° C. or lower.

When the green compact is heat-treated, heat may change the silicone resin coating into an insulating coating having a composition containing Si and C. The silicone resin may also change into silicon oxide such as silica ($SiO_2$), and thus the insulating coating may contain $SiO_2$. Even if the heat treatment changes the composition of the coating formed on particles of the soft magnetic powder, the coating density is maintained. Therefore, the particles of the soft magnetic powder are insulated from each other in the dust core.

Advantageous Effects

In the above-described method for producing a dust core according to an embodiment, a coated magnetic powder produced by the above-described method for producing a coated magnetic powder according to an embodiment is used as a raw material. Therefore, a dust core with low iron loss can be produced.

<<Use of Dust Core>>

The dust core produced by the above-described method for producing a dust core according to an embodiment can be used as a core for electromagnetic components. Since this dust core has low iron loss, the energy efficiency of electromagnetic components can be improved.

<Method for Producing Electromagnetic Component>

The method for producing an electromagnetic component according to an embodiment includes a step of providing a coil to a dust core produced by the above-described method for producing a dust core according to an embodiment. Thus, an electromagnetic component including a dust core and a coil provided to the dust core can be produced.

Advantageous Effects

In the above-described method for producing an electromagnetic component according to an embodiment, a dust core produced by the above-described method for producing a dust core according to an embodiment is used as a core for electromagnetic components. Therefore, an electromagnetic component with low iron loss and high energy efficiency can be produced. Examples of the electromagnetic component include reactors and motors.

Example 1

A coated magnetic powder was produced by the production method according to the embodiment. A dust core was produced using the coated magnetic powder, and evaluation was performed.

In Example 1, an iron-based alloy powder (average particle size: 120 μm) having a composition of Fe-3 mass % Si (the Si content was 3 mass % and the balance was Fe and unavoidable impurities) was prepared as a soft magnetic powder. The average particle size of this powder was determined by performing measurement with a laser diffraction/scattering particle size distribution analyzer and calculating a particle size at which the cumulative mass reached 50% of the mass of all particles. The prepared soft magnetic powder was produced by a gas atomization process and had a hardness of HV 200.

A silicone emulsion was prepared by dispersing a silicone resin in water using a surfactant. The silicone resin was a methyl phenyl silicone resin including a methyl group and a phenyl group at a molar ratio of 4:1 (i.e., the content of a phenyl group: 25 mol %) and having a weight-average molecular weight of 2000. The molar ratio of a methyl group and a phenyl group was determined from the peak intensity ratio of a methyl group and a phenyl group in an infrared absorption spectrum obtained by performing infrared spectroscopic analysis. The weight-average molecular weight of the silicone resin was determined by gel permeation chromatography. The surfactant was a nonionic surfactant having a polyoxyethylene $(CH_2CH_2O)_n$ structure. The weight-average molecular weight of the surfactant was 500. The weight-average molecular weight of the surfactant was determined by matrix-assisted laser desorption/ionization.

The silicone resin was mixed with water containing a surfactant and stirred to prepare a silicone emulsion. The silicone emulsion was prepared by mixing water and the silicone resin at a mass ratio of 1:1 so as to have a silicone resin content of 50 mass %. The average particle size of silicone particles in the silicone emulsion was 300 nm. The average particle size of the silicone particles was determined by performing measurement with a laser diffraction/scattering particle size distribution analyzer and calculating a particle size at which the cumulative mass reached 50% of the mass of all particles.

The prepared silicone emulsion was applied onto particle surfaces of a soft magnetic powder and dried to coat the particle surfaces with the silicone resin. Thus, a coated magnetic powder was produced. The coating was performed as follows.

The soft magnetic powder and the silicone emulsion were inserted into a mixer and mixed with each other under stirring in the mixer. Thus, the silicone emulsion was applied onto the particle surfaces of the soft magnetic powder and dried. Specifically, the soft magnetic powder was dried by sending hot air at 80° C. to the mixer while the soft magnetic powder and the silicone emulsion were mixed with each other under stirring. That is, the application and drying of the silicone emulsion were simultaneously performed through a single process. The saturated water vapor pressure in this atmosphere was 47 kPa and the temperature of the powder was 40° C. Furthermore, the mixing was performed so that the solid content (silicone resin) of the silicone emulsion was 0.3 parts by weight relative to 100 parts by weight of the soft magnetic powder.

The hardness of the silicone resin coating formed by applying the silicone emulsion was measured. For the hardness of the silicone resin coating, the pencil hardness of a silicone resin coating formed by applying the silicone emulsion onto a steel sheet and then performing drying was measured in conformity with "Scratch hardness (Pencil method)" of JIS K 5600-5-4:1999. As a result, the pencil hardness of the silicone resin coating was H.

The thus-produced coated magnetic powder was referred to as sample No. 1-1. A dust core was produced using the coated magnetic powder as a raw material. The dust core was produced as follows.

A mold was filled with the coated magnetic powder. Press molding was performed at a molding pressure of 980 MPa to prepare a ring-shaped green compact having an outside diameter of 30 mm, an inside diameter of 20 mm, and a height of 5 mm. The molding temperature (mold temperature) was set to 80° C. Then, the green compact was heat-treated in a nitrogen atmosphere at 800° C. for 15 minutes to produce a dust core.

A coated magnetic powder referred to as sample No. 1-2 was produced in the same manner as in the sample No. 1-1, except that the content of the phenyl group in the methyl phenyl silicone resin was changed so that the silicone resin coating had a hardness of 6H. A dust core was produced using the coated magnetic powder in the same manner as in the sample No. 1-1. In the sample No. 1-2, the content of the phenyl group was set to 40 mol %.

Coated magnetic powders referred to as sample No. 1-3 and sample No. 1-4 were produced in the same manner as in the sample No. 1-1, except that the content of the phenyl group in the methyl phenyl silicone resin was changed so that the silicone resin coatings had hardnesses of F and 7H, respectively. Dust cores were produced using the coated magnetic powders in the same manner as in the sample No. 1-1. In the sample No. 1-3, the content of the phenyl group was set to 15 mol %. In the sample No. 1-4, the content of the phenyl group was set to 60 mol %.

For comparison, a coated magnetic powder referred to as sample No. 100 was produced in the same manner as in the sample No. 1-1, except that an organic solvent solution prepared by dissolving the silicone resin in xylene was used instead of the silicone emulsion. A dust core was produced using the coated magnetic powder in the same manner as in the sample No. 1-1.

For the dust cores produced using the coated magnetic powders referred to as the samples No. 1-1 to No. 1-4 and No. 100, the iron loss (core loss) was measured. Herein, the iron loss was measured by a secondary winding method by using a primary winding with 300 turns and a secondary winding with 30 turns on the dust core. The iron loss was measured at room temperature (25° C.) using an AC B—H analyzer (manufactured by METRON, Inc.). For the measurement conditions, the excitation flux density Bm was set to 1 T (10 kG) and the measurement frequency was set to 1 kHz. Table 1 shows the results.

TABLE 1

| Sample No. | Core loss (W/kg) |
|---|---|
| 1-1 | 66 |
| 1-2 | 69 |
| 1-3 | 75 |
| 1-4 | 79 |
| 100 | 97 |

As is clear from the results in Table 1, the coated magnetic powders referred to as the samples No. 1-1 to No. 1-4 that were produced using the silicone emulsion can considerably reduce the iron loss of their dust cores compared with the sample No. 100 that was produced using the silicone resin organic solvent solution. This is believed to be because the samples in which the silicone emulsion is applied onto particle surfaces of the soft magnetic powder to form a silicone resin coating have a dense coating formed thereon. In particular, the coated magnetic powders referred to as the samples No. 1-1 and No. 1-2 in which the silicone resin coating has a hardness of H or more and 6H or less can reduce the iron loss of their dust cores compared with the coated magnetic powder referred to as the sample No. 1-3 in which the silicone resin coating has a hardness of F, and thus the samples No. 1-1 and No. 1-2 are found to have a high iron-loss-reduction effect. This is believed to be because the silicone resin coating has a hardness of H or more in the coated magnetic powders referred to as the samples No. 1-1 and No. 1-2 and thus the coating has high strength, which makes it difficult to cause damage to the coating during compaction. The coated magnetic powders referred to as the samples No. 1-1 and No. 1-2 can reduce the iron loss of their dust cores compared with the coated magnetic powder referred to as the sample No. 1-4 in which the silicone resin coating has a hardness of 7H, and thus the samples No. 1-1 and No. 1-2 are found to have a high iron-loss-reduction effect. This is believed to be because the silicone resin coating has a hardness of 6H or less in the coated magnetic powders referred to as the samples No. 1-1 and No. 1-2 and thus the coating has high flexibility, which makes it difficult to cause separation of the coating during compaction.

Example 2

In Example 2, an iron-based alloy powder (average particle size: 40 μm) having a composition of Fe-9.5 mass % Si-5.5 mass % Al (the Si content was 9.5 mass %, the Al content was 5.5 mass %, and the balance was Fe and unavoidable impurities) was prepared as a soft magnetic powder. The prepared soft magnetic powder was produced by a gas atomization process and had a hardness of HV 500.

In the same manner as in the sample No. 1-1 of Example 1, the same silicone emulsion as that of the sample No. 1-1 was applied onto particle surfaces of the soft magnetic powder and dried to coat the particle surfaces with a methyl phenyl silicone resin. Thus, a coated magnetic powder was produced. The produced coated magnetic powder was referred to as sample No. 2. A dust core was produced using the coated magnetic powder in the same manner as in the sample No. 1-1.

For comparison, a coated magnetic powder referred to as sample No. 200 was produced in the same manner as in the sample No. 2, except that an organic solvent solution prepared by dissolving the silicone resin in xylene was used instead of the silicone emulsion. A dust core was produced using the coated magnetic powder in the same manner as in the sample No. 2.

For the dust cores produced using the coated magnetic powders referred to as the samples No. 2 and No. 200, the iron loss (core loss) was measured. The iron loss was measured in the same manner as in Example 1, except that the excitation flux density Bm was set to 0.1 T and the measurement frequency was set to 100 kHz. Table 2 shows the results.

TABLE 2

| Sample No. | Core loss (W/kg) |
|---|---|
| 2 | 152 |
| 200 | 226 |

The results in Table 2 show that, as in Example 1, the coated magnetic powder referred to as the sample No. 2 that was produced using the silicone emulsion can considerably reduce the iron loss of its dust core compared with the sample No. 200 that was produced using the organic solvent solution.

REFERENCE SIGNS LIST

100, 101 silicone resin coating
10, 11 silicone particle
200 particle of soft magnetic powder

The invention claimed is:

1. A method for producing a coated magnetic powder in which particle surfaces of a soft magnetic powder are coated with a silicone resin, the method comprising:

preparing a silicone emulsion by adding a silicone resin into water containing a surfactant with stirring, the silicone emulsion consisting of the silicone resin, the surfactant and the water;

applying the silicone emulsion onto particle surfaces of a soft magnetic powder; and drying the soft magnetic powder after the silicone emulsion is applied, wherein the surfactant is a nonionic surfactant having a polyoxyethylene structure and has a weight-average molecular weight in an inclusive range of 300 or more through 700 or less, and an average particle size of particles of the silicone resin dispersed in the silicone emulsion is 200 nm or more, the silicone resin is dimethyl silicone resin or methyl phenyl silicone resin.

2. The method for producing a coated magnetic powder according to claim 1, wherein the silicone resin has a weight-average molecular weight in an inclusive range of 1000 or more through 30000 or less.

3. The method for producing a coated magnetic powder according to claim 1, wherein the silicone resin is a methyl phenyl silicone resin in which some of methyl groups are substituted with phenyl groups, the silicone resin containing the phenyl groups in an amount that is in an inclusive range of 20 mol % or more through 50 mol % or less.

4. The method for producing a coated magnetic powder according to claim 1, wherein the soft magnetic powder is formed of an Fe—Si—Al-based alloy or an Fe—Si-based alloy and has a Vickers hardness of HV 150 or more.

5. The method for producing a coated magnetic powder according to claim 1, wherein a silicone resin coating on the particle surfaces of the soft magnetic powder has a pencil hardness in an inclusive range of H or more through 6H or less.

6. The method for producing a coated magnetic powder according to claim 1, wherein the drying comprises drying at a saturated water vapor pressure of 20 kPa or more.

7. The method for producing a coated magnetic powder according to claim 1, wherein a content of the silicone resin in the silicone emulsion is in an inclusive range of 10 mass % or more through 60 mass % or less.

8. A method for producing a dust core, comprising:

performing the method according to claim 1 to produce a coated magnetic powder;

compacting the coated magnetic powder to obtain a green compact; and heating the green compact to form the dust core.

9. The method for producing a dust core according to claim 8, wherein the silicone resin has a weight-average molecular weight in an inclusive range of 1000 or more through 30000 or less.

10. The method for producing a dust core according to claim 8, wherein the silicone resin is a methyl phenyl silicone resin in which some of methyl groups are substituted with phenyl groups, the silicone resin containing the phenyl groups in an amount that is in an inclusive range of 20 mol % or more through 50 mol % or less.

11. The method for producing a dust core according to claim 8, wherein the soft magnetic powder is formed of an Fe—Si—Al-based alloy or an Fe—Si-based alloy and has a Vickers hardness of HV 150 or more.

12. The method for producing a dust core according to claim 8, wherein a silicone resin coating on the particle surfaces of the soft magnetic powder has a pencil hardness in an inclusive range of H or more through 6H or less.

13. A method for producing an electromagnetic component, comprising:

performing the method according to claim 8 to produce a dust core; and providing a coil to the dust core to form the electromagnetic component.

14. The method for producing an electromagnetic component according to claim 13, wherein the silicone resin has a weight-average molecular weight in an inclusive range of 1000 or more through 30000 or less.

15. The method for producing an electromagnetic component according to claim 13, wherein the silicone resin is a methyl phenyl silicone resin in which some of methyl groups are substituted with phenyl groups, the silicone resin containing the phenyl groups in an amount that is in an inclusive range of 20 mol % or more through 50 mol % or less.

16. The method for producing an electromagnetic component according to claim 13, wherein the soft magnetic powder is formed of an Fe—Si—Al-based alloy or an Fe—Si-based alloy and has a Vickers hardness of HV 150 or more.

17. The method for producing an electromagnetic component according to claim 13, wherein a silicone resin coating on the particle surfaces of the soft magnetic powder has a pencil hardness in an inclusive range of H or more through 6H or less.

* * * * *